US009357606B2

(12) United States Patent
Varga et al.

(10) Patent No.: US 9,357,606 B2
(45) Date of Patent: May 31, 2016

(54) LIGHTING DEVICE AND CONTROL DEVICE FOR CONTROLLING A PLURALITY OF LIGHT-EMITTING DIODES IN AN OPEN-LOOP AND/OR CLOSED-LOOP MANNER

(75) Inventors: Horst Varga, Lappersdorf (DE); Sebastian Lyschick, Regensburg (DE); Torben Frahm, Resensburg (DE)

(73) Assignee: OSRAM OPTO SEMICONDUCTORS GmbH, Regensburg (DE)

( * ) Notice: Subject to any disclaimer, the term of this patent is extended or adjusted under 35 U.S.C. 154(b) by 248 days.

(21) Appl. No.: 14/113,807

(22) PCT Filed: Apr. 16, 2012

(86) PCT No.: PCT/EP2012/056916

§ 371 (c)(1),
(2), (4) Date: Feb. 7, 2014

(87) PCT Pub. No.: WO2012/146502

PCT Pub. Date: Nov. 1, 2012

(65) Prior Publication Data

US 2014/0139136 A1 May 22, 2014

(30) Foreign Application Priority Data

Apr. 27, 2011 (DE) ..... 10 2011 018 808

(51) Int. Cl.
*H05B 33/08* (2006.01)
*F21V 3/00* (2015.01)

(Continued)

(52) U.S. Cl.
CPC ..... *H05B 33/0845* (2013.01); *H05B 33/0818* (2013.01); *H05B 33/0827* (2013.01);

(Continued)

(58) Field of Classification Search
CPC ..... H05B 33/0815; H05B 33/0803; H05B 33/0818; H05B 33/0833; H05B 33/0863; H05B 37/029; G09G 2320/064; G09G 3/3413; G09G 2320/0666; F21Y 2101/02; F21K 9/00
USPC ..... 315/294, 291, 307, 312, 318; 362/227, 362/231, 311.02, 249.02, 249.03
See application file for complete search history.

(56) References Cited

U.S. PATENT DOCUMENTS 7,252,408 B2 8/2007 Mazzochette et al.
7,821,194 B2 * 10/2010 Negley et al. ..... 313/498

(Continued)

FOREIGN PATENT DOCUMENTS

CN 101288341 A 10/2008
CN 101749636 A 6/2010

(Continued)

OTHER PUBLICATIONS

"LED modules portfolio", Philips Lighting Electronics N.A., 2010, pp. 1-6.

(Continued)

*Primary Examiner* — Haissa Philogene
(74) *Attorney, Agent, or Firm* — McDermott Will & Emery LLP

(57) ABSTRACT

The invention relates to a lighting device having at least one light-emitting diode module (1), which comprises at least two light-emitting diodes (11), which during operation emit light having colors that differ from each other, at least one driver (2), which is designed to supply the light-emitting diodes (11) of exactly one of the at least one light-emitting diode modules (1) with operating current, exactly one control device (3), which during operation controls the at least one light-emitting diode module (1) in an open-loop and/or closed-loop manner, wherein each light-emitting diode module (1) is biuniquely associated with a driver (2), and the control device (3) controls each light-emitting diode module (1) in an open-loop and/or closed-loop manner by means of the driver associated with the light-emitting diode module (1).

14 Claims, 4 Drawing Sheets

(51) Int. Cl.

| | |
|---|---|
| *F21K 99/00* | (2016.01) |
| *F21Y 101/02* | (2006.01) |
| *F21Y 113/00* | (2016.01) |
| *F21V 29/70* | (2015.01) |

(52) U.S. Cl.

CPC ..... *H05B33/0848* (2013.01); *H05B 33/0857* (2013.01); *F21K 9/1355* (2013.01); *F21V 3/00* (2013.01); *F21V 29/70* (2015.01); *F21Y 2101/02* (2013.01); *F21Y 2113/005* (2013.01)

(56) References Cited

U.S. PATENT DOCUMENTS

| | | | | |
|---|---|---|---|---|
| 7,926,300 | B2 | 4/2011 | Roberts et al. | |
| 8,613,530 | B2 * | 12/2013 | Allen et al. | 362/308 |
| 8,648,367 | B2 * | 2/2014 | Oberleitner | 257/98 |
| 2003/0057886 | A1 | 3/2003 | Lys et al. | |
| 2004/0245946 | A1 | 12/2004 | Halter | |
| 2007/0115662 | A1 | 5/2007 | Roberts et al. | |
| 2008/0129224 | A1 | 6/2008 | Shih et al. | |
| 2010/0237766 | A1 * | 9/2010 | Baumgartner et al. | 313/498 |
| 2013/0285081 | A1 * | 10/2013 | Kuhn et al. | 257/88 |
| 2014/0014984 | A1 * | 1/2014 | Gartner et al. | 257/89 |

FOREIGN PATENT DOCUMENTS

| | | | |
|---|---|---|---|
| DE | 102005049579 | A1 | 4/2007 |
| DE | 102008025865 | A1 | 12/2009 |
| DE | 102008029816 | A1 | 12/2009 |
| DE | 10 2011 010 895 | A1 * | 8/2012 |
| EP | 2200404 | A2 | 6/2010 |

OTHER PUBLICATIONS

"Technical application guide PrevaLED Core Z2 light engines", OSRAM GmbH, Jun. 2013, pp. 1-27.

Brilliant Mix—Professional White for General Lighting Application Note, Osram Opto Semiconductors, Jan. 31, 2011, pp. 1-14.

* cited by examiner

LIGHTING DEVICE AND CONTROL DEVICE FOR CONTROLLING A PLURALITY OF LIGHT-EMITTING DIODES IN AN OPEN-LOOP AND/OR CLOSED-LOOP MANNER

SUMMARY

A lighting device is provided. An object to be achieved consists in providing a lighting device in which the luminous means can be driven in a particularly simple way.

According to at least one embodiment of the lighting device, the lighting device comprises at least one light-emitting diode module. The at least one light-emitting diode module comprises at least two light-emitting diodes that emit light of different colors to one another during operation. The light-emitting diodes in this case constitute the light sources of the light-emitting diode module. That is to say, the light emitted by the light-emitting diode module during operation is composed of the light from the operated light-emitting diodes of the light-emitting diode module. The light-emitting diodes differ in this case in terms of the color of the light which they emit during operation. For example, the light-emitting diodes may be light-emitting diodes which are based on different semiconductor material systems. Thus, for example, one of the light-emitting diodes may be suitable for emitting red light during operation, while another light-emitting diode is adapted to emit blue light, and in turn a further light-emitting diode is adapted to emit green light during operation.

The light-emitting diodes of the light-emitting diode module are, for example, arranged on a common circuit board of the light-emitting diode module. The light-emitting diodes may be unpackaged light-emitting diodes, that is to say light-emitting diode chips which are fastened directly on the circuit board. It is furthermore possible for the light-emitting diodes to be packaged light-emitting diodes, which are mechanically fastened and electrically connected on the common circuit board.

For example, the lighting device comprises two or more of these luminous modules. The luminous modules may in this case be constructed in the same way, that is to say they comprise for example an identical number of light-emitting diodes of the same type in the same arrangement. With the light-emitting diode modules, for example, it is then possible to form a flat light in which the individual luminous modules are arranged next to one another, for example in rows and columns in the manner of a matrix. Scalable flat lights having luminous surface dimensions of 60×60 cm or more may in this case be formed.

According to at least one embodiment of the lighting device, the lighting device comprises at least one driver, which is adapted to supply the light-emitting diodes of precisely one light-emitting diode module with operating current. The driver for the light-emitting diodes of this light-emitting diode module may, for example, in this case be arranged away from the light-emitting diode module. That is to say, the driver which supplies the light-emitting diodes of a light-emitting diode module with the necessary operating current is an independent component of the lighting device, which is manufactured separately from the light-emitting diode module. The driver is, for example, connected to a current supply, which may for instance be a standard power supply unit.

For example, it is possible for each light-emitting diode module to be biuniquely assigned a driver. That is to say, the number of drivers in the lighting device then corresponds to the number of light-emitting diode modules and each driver is connected to precisely one light-emitting diode module in order to supply its light-emitting diodes with the necessary operating current.

According to at least one embodiment of the lighting device, the lighting device comprises precisely one control device, which controls and/or regulates the at least one light-emitting diode module during operation. In this case, the control device is intended to control and/or regulate all the light-emitting modules and thus also all the light-emitting diodes of the lighting device. The control and/or regulation of the light-emitting diode modules of the lighting device is not in this case carried out directly by the control device, but rather the control device controls and/or regulates the light-emitting diode modules of the lighting device by means of the drivers assigned to the light-emitting diode modules. That is to say, each driver of a light-emitting diode module is connected to the control device. The light-emitting diode module is then controlled and/or regulated indirectly by the control device by means of this driver. To this end, for example, the control device may impart drive signals to the driver, which the latter in turn converts into the suitable operating current for operating the light-emitting diodes of the assigned light-emitting diode module.

According to at least one embodiment of the lighting device, the lighting device comprises at least one light-emitting diode module, which comprises at least two light-emitting diodes that emit light of different colors to one another during operation. Furthermore, the lighting device comprises at least one driver, which is adapted to supply the light-emitting diodes of precisely one of the at least one light-emitting diode modules with operating current. The lighting device furthermore comprises precisely one control device, which controls and/or regulates the at least one light-emitting diode module during operation. In this case, each light-emitting diode module is biuniquely assigned a driver and the control device controls and/or regulates each light-emitting diode module by means of the driver assigned to the light-emitting diode module. For example, it is possible for one driver and one light-emitting diode module respectively to be integrated in a lamp. The control device may then drive a multiplicity of such lamps.

A lighting device as described here is in this case distinguished inter alia by its modular structure. That is to say, with the control device, a control or regulation unit is employed which is adapted to control or regulate a multiplicity of different light-emitting diodes. For operating the control device, the control device is in this case preferably connected to the same current supply as the drivers of the light-emitting diode modules. The control device may drive a large number of light-emitting diodes, or light-emitting diode modules, via their drivers, which permits a lighting device that can be scaled without great outlay. The number of light-emitting diode modules, or light-emitting diodes, of the lighting device is in this case restricted merely by the FAN-OUT of the signal output of the control device, via which the signals for driving the light-emitting diode modules, or the light-emitting diodes, are fed out of the control device.

According to at least one embodiment of the lighting device, the driver is adapted to supply groups of light-emitting diodes of the assigned light-emitting diode module independently of one another with operating current. That is to say, each driver can simultaneously supply the light-emitting diodes of a group of light-emitting diodes of the assigned module with operating current, in which case light-emitting diodes of a different group of the assigned module can be supplied independently thereof with operating current by the driver. For example, the groups of light-emitting diodes of the light-emitting diode module are sorted in respect of the color of the light emitted by the light-emitting diodes during operation. That is to say, light-emitting diodes of the light-emitting diode module which emit light of the same color during operation are then combined to form a group, which can be supplied with operating current independently of other groups of the light-emitting diode module. For example, the light-emitting diode module contains light-emitting diodes of a group A, a group B and a group C, having a particular number x, y and z, in order to be able to represent a desired color range by the light-emitting diode module. The maximum number for x, y and z is dictated by the maximum supply voltage for the light-emitting diode module. The ratio of x, y and z to one another determines, for example as a function of the brightness classes of the light-emitting diodes and of the operating current with which the light-emitting diodes are powered, the maximum possible photometric parameters such as chromaticity and luminous flux of the light emitted by the light-emitting diode module during operation.

The number of light-emitting diode groups A, B and C is given by additive color mixing theory. If so required, it is in this case possible for a light-emitting diode module to comprise more than three groups of light-emitting diodes, for example four groups of light-emitting diodes. For a high color rendering index, for example, it may be desirable in general lighting to combine red, blue, green and white light-emitting diodes in a light-emitting diode module.

The desired total luminous flux of the light emitted by the light-emitting diode module during operation is given by the sum of the individual luminous fluxes of the light-emitting diodes. Correspondingly, the total luminous flux of the light generated by the lighting device during operation is given by the sum of the individual luminous fluxes of the light-emitting diode modules. A higher luminous flux may, for example, be achieved by a higher operating current for the light-emitting diodes of the light-emitting diode modules and/or a higher duty cycle when driving the light-emitting diodes by means of pulse width modulation.

The light-emitting diode modules are respectively driven by individual modular drivers, which in particular are adapted to supply the individual light-emitting diode groups with operating current individually and independently of one another.

According to at least one embodiment of the lighting device, the control device comprises a multiplicity of signal outputs, pulse width modulated signals which are respectively intended for the operation of one group of light-emitting diodes being delivered via each signal output during operation. In this case, it is possible for the control device to deliver signals for the individual groups of the light-emitting diode modules. The control device is then adapted to drive each group of light-emitting diodes of each light-emitting diode module of the lighting device independently of the other groups.

It is simpler and preferred, however, for the control device to be adapted to operate identical groups of the light-emitting diode modules together. In the aforementioned example comprising groups of light-emitting diodes which emit red, green, blue and white light, it would be sufficient for the control device to have four signal outputs, which deliver pulse width modulated signals for driving the red, blue, green and white light-emitting diode groups. The number of signal outputs of the control device then corresponds to the number of different groups of light-emitting diodes of the light-emitting diode modules of the lighting device, the groups being combined for example in terms of the color of the light emitted by the light-emitting diodes of the groups.

According to at least one embodiment of the lighting device, the at least one light-emitting diode module comprises a sensor for determining an operating status of the light-emitting diode module, the sensor generating, during operation, a measurement signal which is correlated with the operating status of at least one light-emitting diode of the light-emitting diode module. For example, the sensor is intended to determine at least one of the following measurement values and to generate a corresponding measurement signal: brightness of the light generated by the light-emitting diodes of the light-emitting diode module, color locus of the light generated by the light-emitting diodes of the light-emitting diode module, temperature of the light-emitting diode module, for example hot-spot temperature of the light-emitting diode module, air humidity at the operating position of the light-emitting diode module, operating time of the light-emitting diodes of the light-emitting diode module. The sensor may in this case comprise a plurality of sensor components, for example a photodiode, a temperature sensor or a humidity sensor.

The measurement value is in this case correlated with the operating status of at least one light-emitting diode of the light-emitting diode module, and corresponds for example to an averaged operating status for all the light-emitting diodes of the light-emitting diode module, for instance a temperature of the light-emitting diode module, which is attributable to the heat loss of all the operated light-emitting diodes of the light-emitting diode module.

The control device then comprises at least one measurement signal input for reception of the measurement signal. The control device is, in particular, adapted to generate the pulse width modulated signals for driving the light-emitting diodes of the light-emitting diode modules as a function of the measurement signal. In this way, regulation of the light-emitting diodes of the light-emitting diode modules, in which an actual value of the measurement signal is tracked to a setpoint value, can be carried out by the control device. In this way, for example, a color regulation accuracy below human perception is possible. Regulation may in this case be carried out in respect of the color locus and the brightness of the light generated by the light-emitting diode modules during operation. Furthermore, aging effects of the light-emitting diodes can be compensated for, for example by increasing the operating current by light-emitting diodes of the light-emitting diode module in order to keep the total brightness particularly constant over the operating time of the light-emitting diode module. Furthermore, the brightness of the light generated may be adjusted as a function of the ambient light, and color locus changes may be carried out as a function of the circadian rhythm. Furthermore, the color locus and the brightness of the light generated by the light-emitting diode modules during operation may be adjusted independently of the binning classes of the light-emitting diodes of the light-emitting diode modules. With the aid of a measurement signal which is correlated with the operating temperature of at least one light-emitting diode or of the light-emitting diode module, overtemperature protection of the lighting device may for example be carried out.

According to at least one embodiment of the lighting device, the control device comprises at least one communication interface, via which signals are entered into the control device or delivered from the control device. By means of the communication interface, it is thus possible to output a status, for example of the light-emitting diode modules of the lighting device, which is determined for example by means of the sensor of the light-emitting diode modules. Furthermore, it is possible to carry out control of the light-emitting diode modules using incoming signals at the communication interface, for example by the pulse width modulated signals being generated as a function of the signals entered into the control device via the communication interface. The communication interface is in this case adapted to work with a wide variety of protocols for data transmission. For example, the protocols may be protocols such as DALI, KNX, DMX, GSM, BLUEOOTH, HTTP and the like. Communication by means of an infrared or radio link, for example, is also possible.

That is to say the communication interface is an expansion port which can be connected to further modules, for example a DMX module. In this way, the lighting device can be expanded by further functionalities in a modular fashion. To this end, for example, the communication interface comprises a UART.

According to at least one embodiment of the lighting device, at least one of the light-emitting diode modules comprises at least one light-emitting diode which emits green-white light during operation, and at least one light-emitting diode which emits red light during operation. For example, all the light-emitting diode modules of the lighting device are constructed in the same way and comprise these light-emitting diodes. In this case, it is possible in particular for each light-emitting diode module to comprise exclusively light-emitting diodes which emit green-white light and light-emitting diodes which emit red light. For example, each light-emitting diode module may in this case comprise two times as many light-emitting diodes which emit green-white light as light-emitting diodes which emit red light.

The green-white light is, in particular, light from the following color locus region in the CIE standard color system: $X \geq 0.26$, in particular 0.28, and $X \leq 0.43$, $Y \geq 0.26$, in particular 0.29, and $Y \leq 0.53$.

It has been found that the combination of green-white light-emitting diodes with red light-emitting diodes particularly straightforwardly permits light-emitting diode modules which can generate warm-white light. By suitable driving of the light-emitting diodes, with such a light-emitting diode module it is possible to generate warm-white mixed light from a color locus region between 2700 K and 4000 K. The light generated by the light-emitting diode modules comprising green-white light-emitting diodes and red light-emitting diodes is furthermore distinguished by a very high color rendering index of up to 94, and a high efficiency. For example, efficiencies of more than 100 lumen/W are possible.

It has disadvantageously been found that, owing to the different temperature behavior of the light-emitting diodes used, color stabilization is necessary in such light-emitting diode modules; this can be carried out in the present case by the control device.

In addition to the lighting device, a control device for controlling and/or regulating a multiplicity of light-emitting diodes is provided. The control device comprises, in particular, a multiplicity of signal outputs, pulse width modulated signals, which are respectively intended for the operation of one or more light-emitting diodes, being delivered via each signal output. The control device furthermore comprises a measurement signal input for the reception of a measurement signal which is correlated with the operating status of at least one of the light-emitting diodes. The control device furthermore comprises a communication interface, via which signals are entered into the control device or delivered from the control device, the control device being adapted to generate the pulse width modulated signals as a function of the measurement signal and as a function of the signals entered into the control device via the communication interface. In this case, the control device can be used, in particular, as a control device in a lighting device as described here. That is to say, all the features disclosed in connection with the lighting device are also disclosed by the control device, and vice versa.

BRIEF DESCRIPTION OF THE DRAWINGS

A lighting device as described here, and a control device as described here, will be explained in more detail below with reference to an exemplary embodiment and the associated figure.

Figure 2:
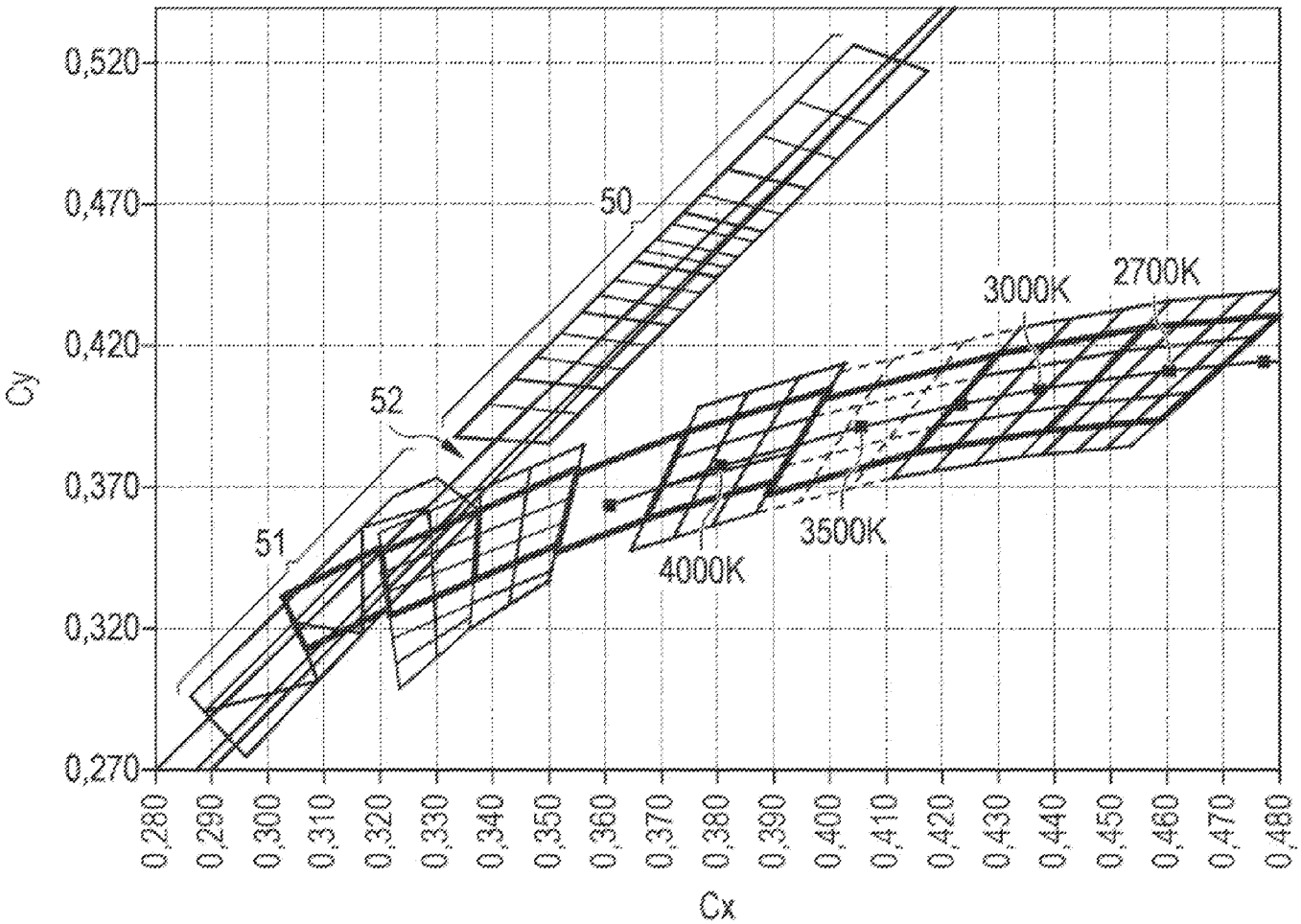
Figure 3:
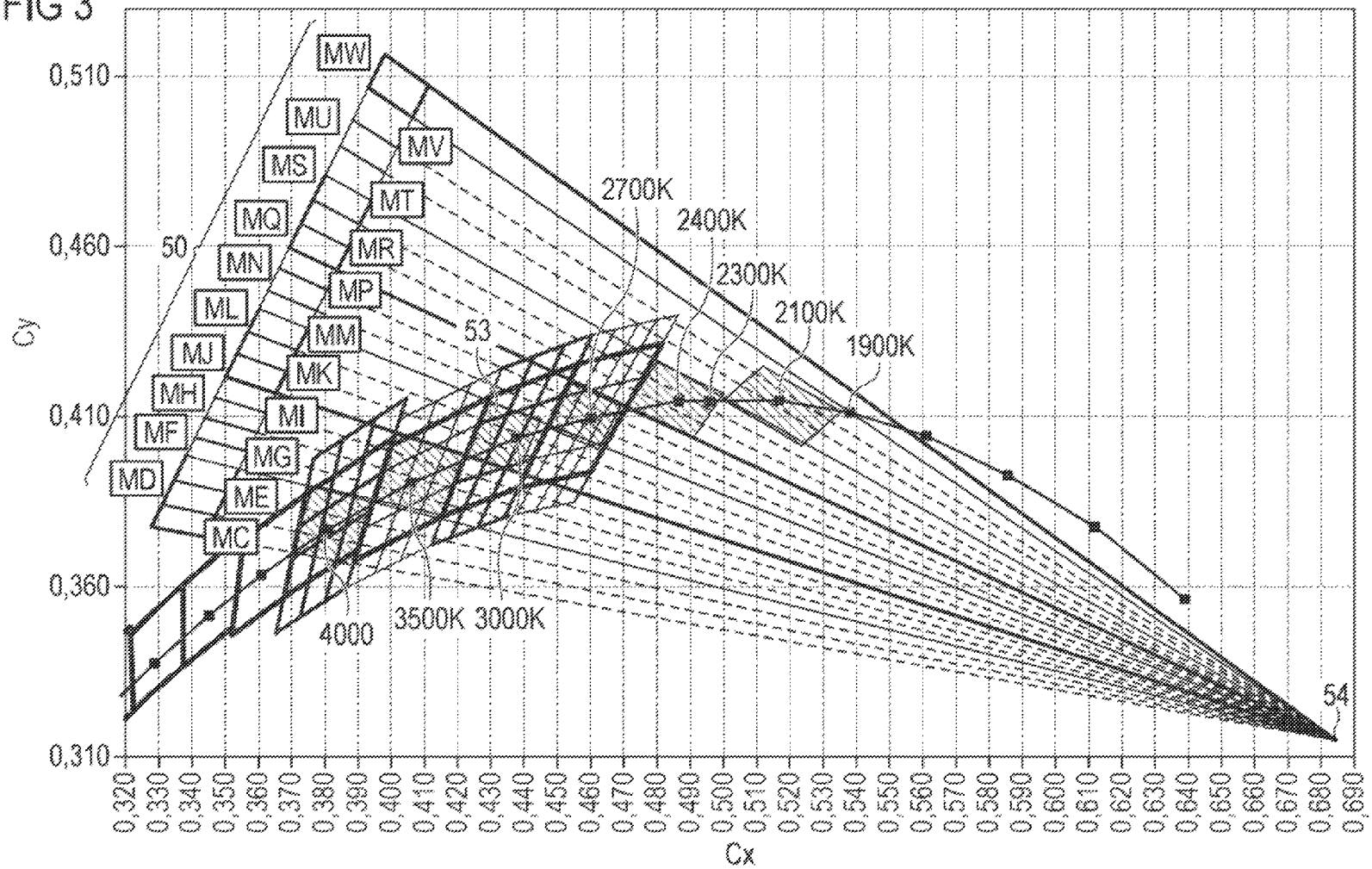

Lighting devices as described here are explained in more detail with the aid of the graphical plots of FIGS. 2 and 3.

DETAILED DESCRIPTION

Figure 1:
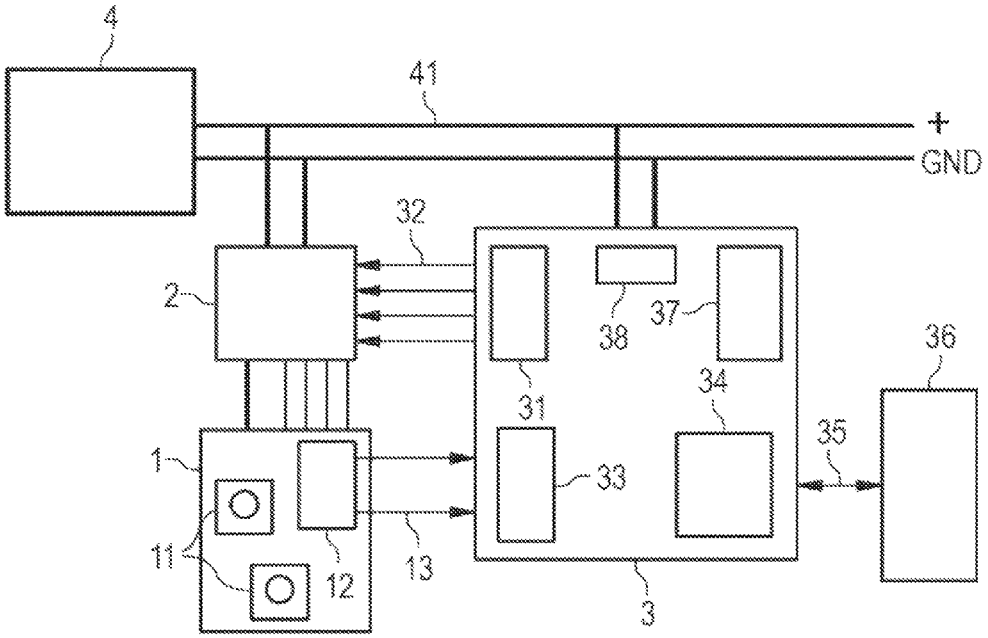
FIGS. 1, 4 show a lighting device as described here with the aid of schematic representations.

With the aid of a schematic representation, FIG. 1 shows a lamp which may be used in a lighting device as described here.

Elements which are the same or of the same type, or which have the same effect, are provided with the same references in the figures. The figures and the size proportions of the elements represented in the figures with respect to one another are not to be regarded as true to scale. Rather, individual elements may be represented exaggeratedly large for better representability and/or for better comprehensibility.

FIG. 1 shows a lighting device as described here with the aid of a schematic representation. The lighting device comprises a light-emitting diode module 1. The light-emitting diode module 1 comprises a multiplicity of light-emitting diodes 11, which are for example arranged on a common circuit board. The light-emitting diode module furthermore comprises a sensor 12, which determines an operating status of the light-emitting diode module 1 and generates a corresponding measurement signal 13. The sensor 12 may in this case comprise a plurality of components, for example a temperature sensor and a photodiode, and may correspondingly generate a plurality of different measurement signals 13.

A driver 2, which supplies the light-emitting diodes of the light-emitting diode module with operating current, is biuniquely assigned to the light-emitting diode module 1. Other than as indicated in FIG. 1, it is in this case possible for the lighting device to comprise a multiplicity of light-emitting diode modules 1 having assigned drivers 2. Furthermore, the light-emitting diodes 11 of the light-emitting diode modules of the lighting device may be divided, for example according to the light generated by them during operation, into groups of light-emitting diodes which emit light of the same color during operation. The driver is then adapted to supply groups of light-emitting diodes of the assigned light-emitting diode module with operating current independently of one another.

The lighting device furthermore comprises a control device 3. The control device 3 comprises a multiplicity of signal outputs 31, which respectively generate a pulse width modulated signal 32 that is intended for operating light-emitting diodes of the light-emitting diode modules 1. For example, each pulse width modulated signal 32 is intended for operating one group of light-emitting diodes of the light-emitting diode modules. In this case, in particular, it is possible for each signal output 31 to generate a pulse width modulated signal 32 which drives all identical groups of the light-emitting diode modules 1 of the lighting device together. The driving of the light-emitting diodes 11 of the light-emitting diode modules 1 is in this case carried out by means of the drivers assigned to the light-emitting diode modules 1. That is to say, the pulse width modulated signals 32 are imparted to the drivers 2, which provide corresponding operating current for operation of the light-emitting diodes 11 of the light-emitting diode modules 1. The drivers 2 are in this case connected to the current supply 4 by current lines 41.

The control device 3 furthermore comprises a measurement signal input 33, via which the measurement signals generated in the light-emitting diode modules 1 by the sensor 12 enter the control device 3. There, for example, they are processed in a microcontroller 37 and converted into corresponding pulse width modulated signals 32, which are then used for regulation of the light-emitting diode modules 1 connected to the control device 3.

The control device 3 furthermore comprises a communication interface 34, via which signals can be entered into the lighting device or can be delivered from the lighting device. To this end, for example, a signal source 36 may be provided, which imparts signals 35 to the control device via the communication interface 34. The signal source may, for example, be a DMX module, a DALI module or the like. Furthermore, it is possible for a connection to further lighting devices of the same type to be set up via the communication interface, for example in order to connect a plurality of lighting devices to one another over a large space.

The control device 3 may furthermore comprise further control interfaces, which are not represented in FIG. 1. For example, the control device may comprise an interface for brightness control, which is formed by means of a 1 to 10 V interface, for example by means of a variable resistor. Similarly, an interface for controlling the color temperature may be provided. Furthermore, two or more digital interfaces may be provided, for example for infrared communication, for instance with a remote control. Inputs for color sensors, temperature sensors and microcontroller programming interfaces may also be provided on the control device 3. The control device 3 may in this case be freely programmable according to the system requirement. In the present case, the control device is likewise connected to the current supply 4 via the current lines 41. The control device 3 may for example comprise a voltage transformer 38, which generates the operating voltage necessary for the control device 3.

FIG. 2 shows a detail enlargement of the CIE standard color chart. In FIG. 2, color locus regions 50 for green-white light are represented. The green-white (or mint) light is obtained, for example, by conversion of blue light which is generated by a light-emitting diode chip.

In this case, for example, it is possible to use a phosphor which, in a lower concentration, permits mixed light from an ultra-white color locus region 51. By increasing the concentration of the luminescent substance, the green-white light from the color locus region 50 for green-white light is obtained. The light is obtained by mixing blue light with the yellow-green light re-emitted by the luminescent substance along the conversion lines 52.

FIG. 3 shows another detail enlargement of the CIE standard color chart. The mixing of light from the color locus region 50 for green-white light with light from the color locus region 54 for red (or amber) light to form warm-white light 53 is graphically represented with the aid of FIG. 3. By suitable driving, for example of light-emitting diodes which emit green-white light and light-emitting diodes which emit red light, it is possible to generate warm-white light along the Planck curve in a color locus region between at least 2700 K and at most 4000 K.

Figure 4:
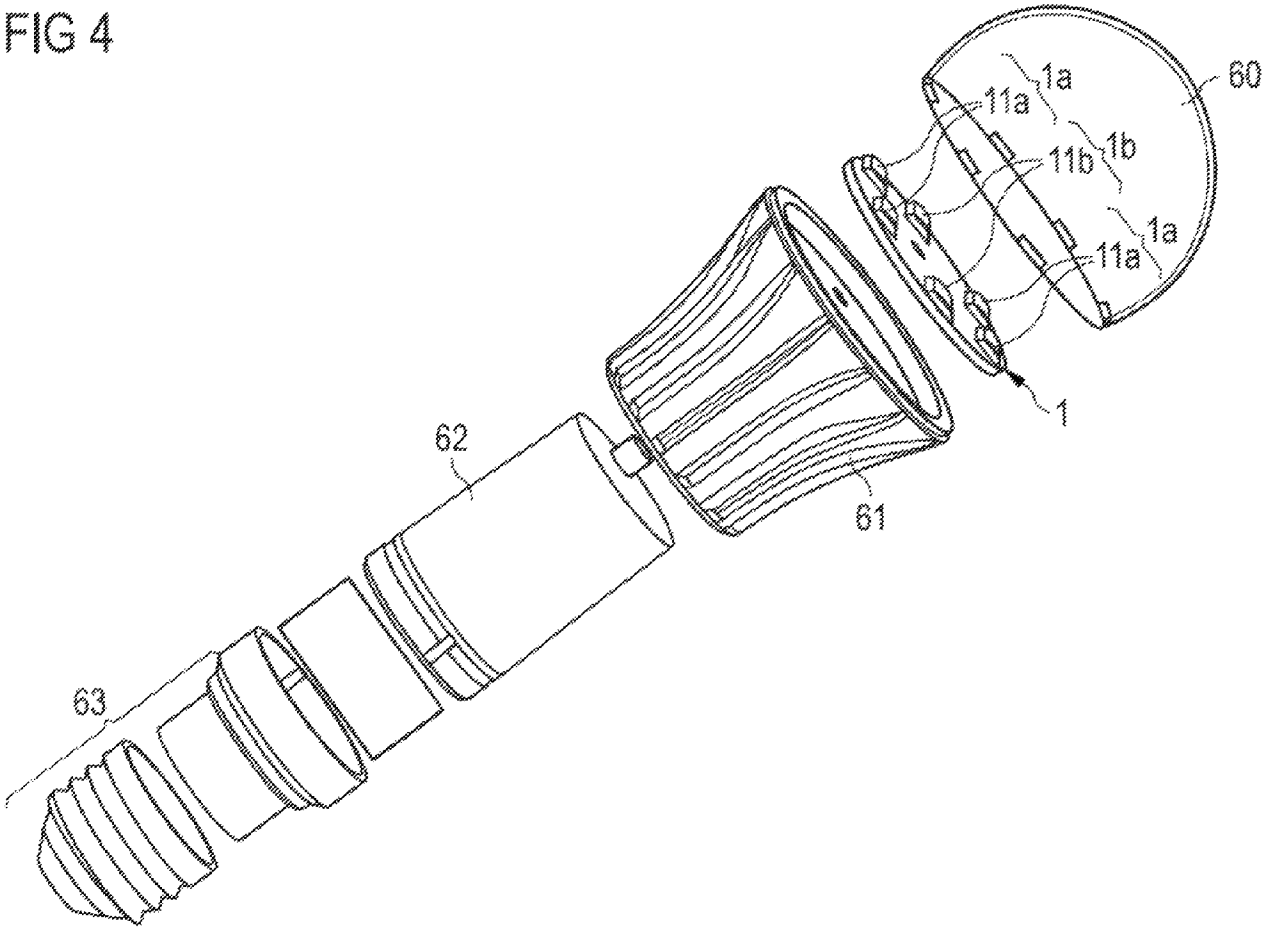

In conjunction with the schematic representation of FIG. 4, a light-emitting diode module 1 is represented which is particularly highly suitable for generating warm-white light and, for example, may be used as a light-emitting diode module 1 in a lighting device as described here. In the present case, the light-emitting diode module 1 is integrated into a lamp. The light-emitting diode module 1 comprises four green-white light-emitting diodes 11*a* and two red light-emitting diodes 11*b*. The green-white light-emitting diodes 11*a* together form the group 1*a* of green-white light-emitting diodes, which may for example be driven together by the control device 3. The group 1*b* of red light-emitting diodes comprising the red light-emitting diodes 11*b* may be operated independently of these light-emitting diodes.

The light-emitting diodes are, for example, arranged on a common circuit board and electrically connected there.

The lamp represented in FIG. 4 furthermore comprises a cover body 60, which is for example formed to be diffusely scattering and is used for mixing the light from the light-emitting diodes 11*a*, 11*b* to form white light.

The lamp furthermore comprises a heat sink 61, which comprises for example cooling fins and is used for cooling the light-emitting diode module 11. The lamp may furthermore comprise a driver 62, which may be the driver 2 as described here for the light-emitting diode module. The driver 62 in this exemplary embodiment is integrated into a lamp together with the light-emitting diode module 1.

The lamp may, for example, be electrically connected via a cap part 63.

The driving of the light-emitting diode module 1 is carried out as shown in connection with FIG. 1. In particular, it is possible for a multiplicity of lamps of the same type, such as represented in FIG. 4, comprising light-emitting diode modules 1, to be driven by the control device 3.

Overall, the lighting device as described here, and the control device as described here, are distinguished by their high flexibility, their universal usability and the low costs for their production. The lighting device as described here follows a modular approach and may be expanded, for example, both by hardware and by corresponding programming The lighting device may, in particular, be employed in effect lighting, general lighting, in produce lighting (for example lighting of vegetables, meat or other produce) and in working lighting (for example in operating rooms).

By the description with the aid of the exemplary embodiments, the invention is not restricted to these exemplary embodiments. Rather, the invention covers any new feature and any combination of features, which includes in particular any combination of features in the patent claims, even if this feature or this combination is not explicitly indicated per se in the patent claims or in the exemplary embodiments.

This patent application claims the priority of the German Patent Application 102011018808.8, the disclosure content of which is incorporated herein by reference.

What is claimed is:

1. A lighting device comprising:

at least one light-emitting diode module, which comprises at least two light-emitting diodes that emit light of different colors to one another during operation;

at least one driver, which is adapted to supply the light-emitting diodes of precisely one of the at least one light-emitting diode modules with operating current; and precisely one control device, which controls or regulates the at least one light-emitting diode module during operation, wherein each light-emitting diode module is biuniquely assigned a driver, wherein the control device controls or regulates each light-emitting diode module by means of the driver assigned to the light-emitting diode module, wherein all the light-emitting diode modules exclusively comprise light-emitting diodes which emit red light during operation and light-emitting diodes which emit light from the following color locus region in the CIE standard color system: X≥0.26 and X≤0.43, Y≥0.26 and Y≤0.53 during operation, and wherein:

the light from all the light-emitting diodes of each of the light-emitting diode modules is mixed to form white light, the control device comprises a multiplicity of signal outputs, pulse width modulated signals, which are respectively intended for the operation of one or more light-emitting diodes, being delivered via each signal output, the control device comprises a measurement signal input for the reception of a measurement signal which is correlated with the operating status of at least one of the light-emitting diodes, the control device comprises at least one communication interface, via which signals are entered into the control device or delivered from the control device, and the control device is adapted to generate the pulse width modulated signals as a function of the measurement signal and as a function of the signals entered into the control device via the communication interface.

2. The lighting device according to claim 1, wherein at least one of the light-emitting diode modules comprises at least one light-emitting diode which emits green-white light during operation, and at least one light-emitting diode which emits red light during operation.

3. The lighting device according to claim 1, wherein the driver is adapted to supply groups of light-emitting diodes of the assigned light-emitting diode module independently of one another with operating current.

4. The lighting device according to claim 3, wherein light-emitting diodes of the light-emitting diode module which emit light of the same color during operation are combined to form a group.

5. The lighting device according to claim 1, wherein the control device comprises a multiplicity of signal outputs, pulse width modulated signals which are respectively intended for the operation of one group of light-emitting diodes being delivered via each signal output.

6. The lighting device according to claim 1, wherein the at least one light-emitting diode module comprises a sensor for determining an operating status of the light-emitting diode module, the sensor generating, during operation, a measurement signal which is correlated with the operating status of at least one light-emitting diode of the light-emitting diode module, and the control device having at least one measurement signal input for reception of the measurement signal.

7. The lighting device according to claim 1, wherein the control device is adapted to generate the pulse width modulated signals as a function of the measurement signal.

8. The lighting device according to claim 1, wherein the control device comprises at least one communication interface, via which signals are entered into the control device or delivered from the control device.

9. The lighting device according to claim 1, wherein the control device is adapted to generate the pulse width modulated signals as a function of the signals entered into the control device via the communication interface.

10. The lighting device according to claim 2, wherein the number of light-emitting diodes which emit green-white light during operation is at least 1.5 and at most 2.5 times the number of light-emitting diodes which emit red light during operation.

11. The lighting device according to claim 2, wherein all the light-emitting diode modules exclusively comprise light-emitting diodes which emit green-white light during operation and light-emitting diodes which emit red light during operation.

12. A lighting device comprising:

at least one light-emitting diode module, which comprises at least two light-emitting diodes that emit light of different colors to one another during operation;

at least one driver, which is adapted to supply the light-emitting diodes of precisely one of the at least one light-emitting diode modules with operating current; and precisely one control device, which controls and/or regulates the at least one light-emitting diode module during operation, wherein each light-emitting diode module is assigned a driver, wherein the control device controls or regulates each light-emitting diode module by means of the driver assigned to the light-emitting diode module, wherein all the light-emitting diode modules exclusively comprise light-emitting diodes which emit green-white light during operation and light-emitting diodes which emit red light during operation, and wherein the light-emitting diodes which emit green-white light during operation emit light from the following color locus region in the CIE standard color system: X≥0.28 and X≤0.43, Y≥0.29 and Y≤0.53.

13. The lighting device according to claim 12, wherein the number of light-emitting diodes which emit green-white light during operation is at least 1.5 and at most 2.5 times the number of light-emitting diodes which emit red light during operation.

14. The lighting device according to claim 12, wherein all light-emitting diode modules generate warm-white mixed light from a color locus region between 2700 K and 4000 K, wherein the light generated by the light-emitting diode modules is generated with an efficiency of more than 100 lumen/W.

* * * * *